United States Patent [19]

Yuter

[11] 4,074,793

[45] Feb. 21, 1978

[54] RESTAURANT DINING SYSTEM

[76] Inventor: Seymour C. Yuter, 407 Cedar Drive West, Briarcliff Manor, N.Y. 10510

[21] Appl. No.: 703,952

[22] Filed: July 9, 1976

[51] Int. Cl.[2] ..... E04H 3/04

[52] U.S. Cl. ..... 186/1 R

[58] Field of Search ..... 40/130 L, 152.2; 52/6, 52/28, 239, 509, DIG. 13, 511; 179/175.3 R; 186/1 R; 198/38; 240/2 AT, 1 E; 340/256; 16/8

[56] References Cited

U.S. PATENT DOCUMENTS

| | | | |
|---|---|---|---|
| 1,314,965 | 9/1919 | Lamont | 186/1 R |
| 1,343,801 | 6/1920 | Turner | 186/1 R X |
| 1,468,956 | 9/1923 | Brooks et al. | 186/1 R |
| 1,507,497 | 9/1924 | Martin | 186/1 R |
| 2,634,530 | 4/1953 | Herschede et al. | 240/2 AT X |
| 3,091,815 | 6/1963 | Krawiec | 186/1 R X |
| 3,263,776 | 8/1966 | Kroemer, Jr. | 186/1 R |
| 3,370,389 | 2/1968 | Macaluso | 52/239 |
| 3,421,290 | 1/1969 | Cheney et al. | 52/6 X |
| 3,531,898 | 10/1970 | Facemire | 52/6 |
| 3,817,015 | 6/1974 | Frangos | 52/511 |
| 3,866,267 | 2/1975 | Poletti | 16/8 |

FOREIGN PATENT DOCUMENTS

| | | | |
|---|---|---|---|
| 1,300,206 | 6/1962 | France | 52/DIG. 13 |

*Primary Examiner*—Stephen G. Kunin
*Attorney, Agent, or Firm*—S. C. Yuter

[57] ABSTRACT

The restaurant dining system described in the specification comprises dining and bar areas, a cocktail lounge, a kitchen and an order-taking post separate from and adjacent the dining and bar areas to facilitate the direct delivery of food and drink orders taken by telephone from patrons in the dining area and cocktail lounge in visual communication with the order-taking person. A combined piano bar-bandstand straddles the bar area and dance floor. Variably-translucent panels control visual communication with the dining area. Each table has its own speaker and volume control for music playing. Detachable carpet panels permit the movement of telephone and audio cables coupled to the tables. A phone protection system signals the cutting of any telephone cable. The bar area may be glass-enclosed to control the sound and smoke levels, and a microphone within the bar area permits the feeding of the bar area sound at a controlled audio level into the audio amplifier system feeding the table speakers.

35 Claims, 12 Drawing Figures

DINING SYSTEM 10

FIG. 5
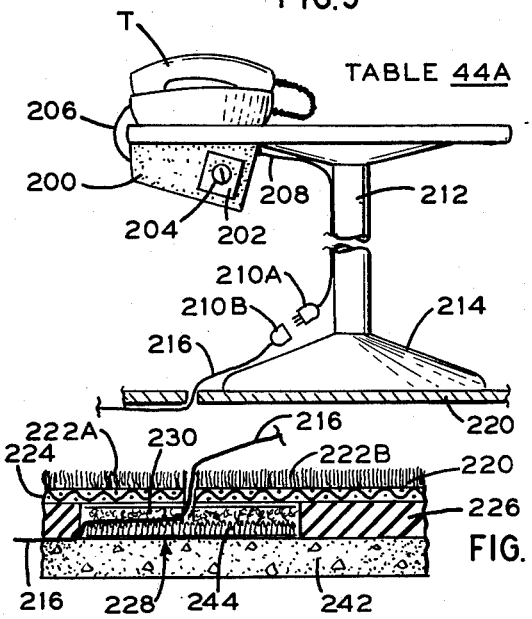
FIG. 6A
FIG. 6B
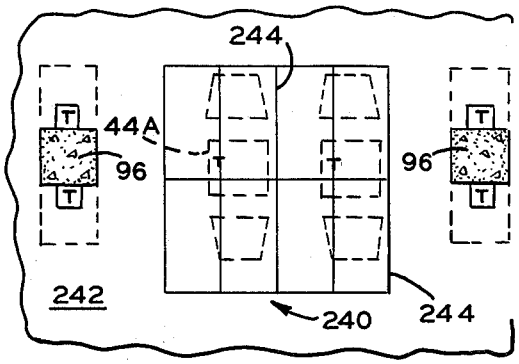
FIG. 7A
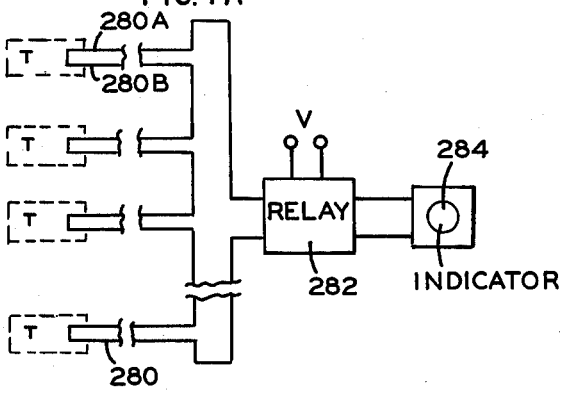
FIG. 7B
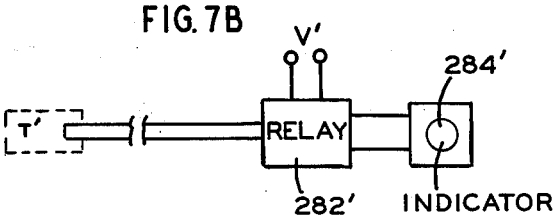
FIG. 8
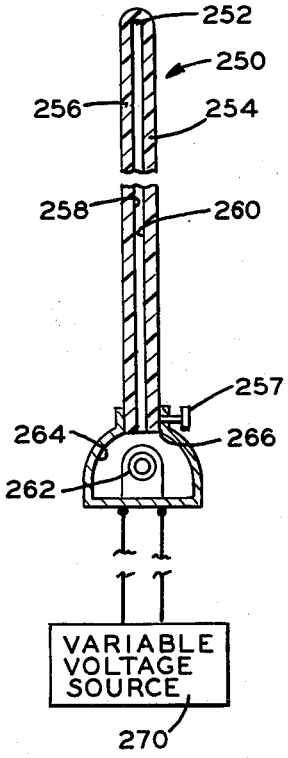

RESTAURANT DINING SYSTEM

This invention relates to a restaurant dining system and, more particularly, to an improved system for taking food and drink orders in a restaurant having a separate dining room, kitchen and preferably also a separate bar.

A more efficient dining system is the principal object of the invention.

A feature of the invention is the use of telephones to take food and drink orders to speed up the order-taking process usually performed by a waiter or waitress recording the order at the table.

The use of telephones to expedite food service is not new. Moreover, telephones have been used in restaurants and cabarets to facilitate inter-table communication to make new friends. Known telephone ordering systems provide for communication between the diner and an unseen person in the kitchen. Audio communication systems have also been used in drive-in eating places to take orders from patrons who remain in their cars.

What is believed to be new and nonobvious, however, is an improved order-taking system for use in restaurants having a separate dining room and kitchen and preferably a separate bar. A completely separate order-taking post is located in a raised position overlooking the tables in the dining area and preferably adjacent to both the kitchen and the bar. The order-taking person is thus in visual communication with people at the dining tables at which telephones are located. This system also permits the order-taking person to determine when a patron is ready to order so that the order-taking person can initiate the call by dialing the table's telephone number. It also provides a personal touch because the patron can see the order-taking person.

The order-taking person makes a separate written order on an order card or check for each table. Separate checks are made for drink orders, usually given first. Written drink orders are passed directly to the adjacent bar. Written food orders are put on an order conveyor connected between the raised order-taking post and the adjacent kitchen. Thus, order taking is expedited and serving personnel can concentrate on delivering drink and food orders to the tables. The telephones at the tables also facilitate requesting the check when the patron is ready to leave. Also to make complaints to the management.

A feature of this system is the provision of a music-playing loud speaker mounted beneath or near each table. With an associated volume control, it permits playing recorded or live music throughout the restaurant at an audio level which facilitates conversation at ordinary voice levels. The loud speaker also provides a junction box for the telephone cable.

The telephone and music wires run between the floor and the carpeting. In order to permit exit of the wires from beneath a table (to avoid tripping hazards), the carpeting consists of rectangular panels, each with Velcro-type fasteners attached in recesses beneath the outer edges of the carpet panel. Mating Velcro-type fasteners are attached to the floor in a matching rectangular grid pattern. The cables exit at abutting carpet panel edges. If a table is moved, the adjacent carpet panel edges can be temporarily raised to move the cable to a new position beneath the moved table. The cables are flat so as to minimize bulging of the carpet. Moreover, worn, damaged or stained carpet panels may readily be replaced. The detachable carpet panels is another feature of the system.

According to the Telephone Compay, phones that are not screwed or bolted to a table surface or wall are liable to be stolen. Since many if not most of the telephones in the system are just resting on tables, apparently there is a significant risk that a phone cable will be cut so that the phone can be removed. The use of the loud speaker cabinet as a junction box (as distinguished from using a pluggable phone-jack system) should help but is not deemed sufficiently secure.

Accordingly, another feature of the system is the use of an extra pair of conductors in the telephone cable as a protective device to signal the cutting of the cable. The pair is shorted or otherwise coupled together inside the phone. In one protective device, all of the protective conductor pairs are connected in series with an indicating relay to signal when the circuit is broken. Preferably, the indicator would be located at the order-taking post so that upon energizing, the order-taking person can survey all of the tables to see if or when a phone is removed. In an alternative embodiment, each telephone protective pair has a separate indicator to signal when its particular circuit is broken by cutting the cable.

A popular feature of some drinking places is a piano or organ bar; i.e., a piano or organ with a partially surrounding counter to support drinking glasses of patrons who watch and listen to the musician. It is also well known to have band stands located adjacent to dance floors for dancing to live music, However, it is believed to be new and nonobvious to combine a piano or organ bar with a bandstand and have it bridge both the bar area and the dance floor, thus doing double duty — i.e., a single musician can perform at the piano or organ bar but there is room on the bandstand extension into the dance floor area to add one or more additional musicians to provide a band for dancing. Such a combined music bar-bandstand is preferably associated with a raised bar so that the extension of the bar floor for the bandstand is naturally raised above the dance floor. That is still another feature of the system.

In a restaurant with a cocktail lounge, there are periods of time when the dining area is substantially empty while the cocktail lounge is busy. At such times, it is desirable to shield the empty dining area from the cocktail lounge. A feature of the present system is the use of edge-lighted panels of light-transmitting material, such as Lucite, with a surface slightly roughened to transmit light. The panel is vertically positioned between the cocktail lounge and the dining area to block visual communication. By controlling the amount of light, preferably from a rheostat at the order-taking post, the panel can be converted from substantially transparent to substantially opaque. Such variablytranslucent panels can also be used adjacent the outside windows to control visual privacy of the dining and other areas.

A major advantage of the dining system is probably not obvious. It flows from the need for many people to make new friends among the opposite sex. That need is significant for many divorced and widowed persons, particularly women. Also for single people who have never married. What makes the problem difficult for many is a perceived requirement of dignity and propriety in a potential meeting place. There are many ways to satisfy that requirement, such as church groups, theatre groups, social societies and other traditional meeting places which provide a measure of dignity. But among the more marginal meeting places are bars, sometimes pejoratively termed "pick-up places." It takes a measure of insensitivity to be able to go to a bar to meet people of the opposite sex. That problem is especially difficult for most women, although many men cannot bring themselves to go to a bar to meet women.

The need for propriety and dignity in a meeting place is substantially satisfied by the present system. That is because communication between telephones is via a dial system so that it is possible for a person at one table or the bar to dial another person at a table. Such communication is encouraged by the provision of live music for dancing. While many men cannot risk rejection, it takes only a minor amount of resolve to ask a woman to dance via telephone. If rejected, he need only hang up rather than have to walk away, as in the more traditional procedure.

The need for propriety and dignity is satisfied by the present system because of the procedure involved. In a normal scenario, for example, two women will come to the restaurant for dinner. If their table is not yet available, they will be requested to wait at a table in the cocktail lounge, not at the bar or in a foyer as in many places. Or they can decide to have a drink in the cocktail lounge before adjourning to the dining area for dinner. In either case, as soon as they are seated, a person at the order-taking post will chime their phone, at which time the phone will light to distinguish the called phone from one nearby. The patron is expected to answer the phone and give the drink order for the table. The order-taking person records the order and delivers the written order to the bar. Servers, waiters and waitresses, concentrate on delivering loaded trays to the ordering tables. Since a service charge will usually be added in lieu of a tip, the servers are not arbitrarily limited to any group of tables. The consequence is that the patrons are served their drinks in a relatively short time. But the point is that the women are properly in the cocktail lounge and are properly answering the phone. That is the system. They are NOT there to be picked up.

But then the phone rings again and, quite properly, one of the women answers it. This time there is a man on the phone explaining that he is up at the bar on the yellow phone, whom she can now see, and he would like the honor of dancing with her. If he seems nice, "why not?" is an expected response.

With this system, most women will not feel like "a piece of meat on a hook being glared at by men."

Naturally, in the public relations for such a restaurant system, everything reasonable is done to negate any image that the restaurant is a "pick-up place." But if the food is good and the prices are reasonable, which should be the case, the dignity and propriety of the system as a desirable restaurant should far outweigh any unfortunate "pick-up" image — certainly for the large majority of people who have a need to make friends of the opposite sex in a way that is consistent with their image of themselves as proper and dignified persons.

Other objects, features and advantages of the present restaurant system will be obvious from the following detailed description taken together with the accompanying drawings in which:

FIG. 1 (FIG. 1) is a floor plan of a preferred embodiment of the dining system invention, generally comprising a dining area, kitchen, bar area, cocktail lounge and order-taking post. Adjacent the bar area is the combined music bar-bandstand. The "T"s represent telephones.

FIG. 5 is a side elevational view of a table for two, partly broken away, in the center of the cocktail lounge, and showing a telephone, a loud speaker mounted beneath the table and the cable plug, with the flat cable passing between edges of carpet panels attached to the floor.

FIG. 6A is an enlarged cross-sectional view of the carpet panel edge construction with the Velcro-type fasteners, and showing the flat cable passing from beneath the carpet.

FIG. 6B is a plan view of a portion of the rectangular grid Velcro-type fasteners attached to the floor, but with the carpet panels removed, and showing tables and chairs in dotted outline.

FIG. 7A is an electrical circuit diagram of the telephone protection circuit for indicating when a phone cable is cut.

FIG. 7B is an electrical circuit diagram of a portion of an alternative embodiment of a phone protection circuit with a separate indicator for each phone.

FIG. 8 is a cross-sectional view of a variably-translucent partition separating the dining area from the cocktail lounge.

DINING SYSTEM (FIG. 1)

Figure 1:
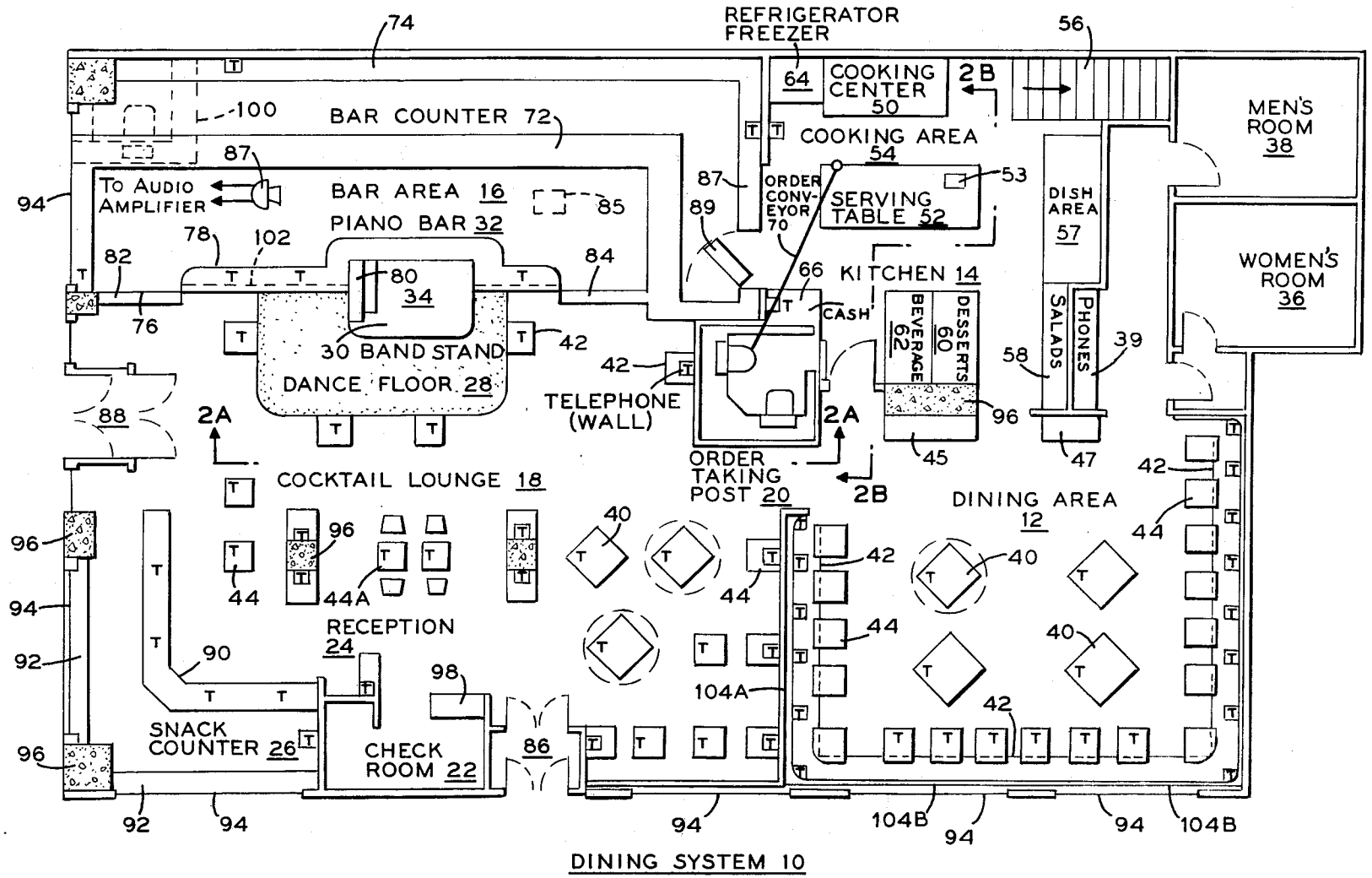

FIG. 1 (FIG. 1) discloses the general arrangement of the dining system in accordance with a preferred embodiment of the invention. Dining system 10 generally comprises the dining area 12, kitchen 14, bar area 16, cocktail lounge 18 and the order-taking post 20. Also included are the check room 22, reception 24, snack counter 26, dance floor 28, bandstand 30 and piano bar 32. The combined music bar-bandstand is designated as 34. Women's room 36, men's room 38 and pay phones 39 complete the general arrangement.

Dining area 12 includes the larger tables 40 and the banquette 42 with smaller tables 44. The "T"s designate telephones on the tables. Enclosed "T"s designate wall-mounted phones. Service stations 45 and 47 facilitate food service by serving personnel.

Kitchen 14 generally comprises a cooking center 50 which, together with serving table 52, makes up the cooking area 54 for short-order dishes. Foods that can be cooked in advance are prepared in a lower kitchen (not shown but which is accessed by stairs 56) and transferred to a steam table facility on serving table 52. Serving table 52 includes a sink 53. Also downstairs are the remaining facilities of a restaurant including lockers, rest rooms for staff, storage, freezers, refrigerators and supporting electrical and air conditioning equipment. In particular the dish washing and pot cleaning equipment is downstairs but a dish area 57 upstairs, adjacent the stairs, is used as a drop for dirty dishes and pots and for the storage of clean dishes and pots. Additional areas include the salad area 58, dessert area 60 and beverage area 62; also a refrigeratorfreezer 64 to service the cooking area 54. A table 65 is also provided for a cashier, later discussed in greater detail.

Finally, the most novel feature of the kitchen 14 is the order conveyor 70 which conveys written orders from the order-taking post 20 to the cooking area 54. The order conveyor 70 will be explained in detail later in connection with FIGS. 2-4.

Bar area 16 generally comprises the bar counter 72, the liquor shelf 74, floor 76 and telephone counter 78. Telephone counter 78 becomes the counter for the piano bar 32 which partially encloses the bandstand 30 which supports the piano or organ 80. The bar floor 76 is raised about one foot from the restaurant floor and especially the dance floor 28. Steps 82 and 84 provide access to the bar area 16. The bandstand 30 extends into the area of the dance floor 28. The difference in levels is later described in connection with FIG. 2A.

Access between the bar area 16 and kitchen 14 is via a serving pass-through 87 which includes the dutch door 89 for transferring liquor, beer barrels, ice, etc., from storage downstairs and refuse to downstairs.

Cocktail lounge 18 generally comprises the larger tables 40 and smaller tables 44. The smaller tables 44 usually seat two and the larger four. Those within a dotted circle are expandable to seat six or more.

Entry to and exit from the restaurant are via doors 86 and 88.

The snack counter 26 generally comprises a service counter 90 and food storage and display counters 92. the food is displayed to passersby via the store windows 94. The snack counter 26 preferably serves mostly cold foods together with cold and hot beverages. Columns 96 are part of the supporting building structure.

The check room 26 includes the coat counter 98.

Shown in dotted outline in the upper lefthand corner of FIG. 1 is an order-taking post 100 in accordance with another embodiment of the system in which the floor of the order-taking post 100 is substantially higher than the level of the bar floor 76. Thus, order-taking persons can see over the heads of patrons at the bar to take drink orders from patrons in the cocktail lounge 18; especially when the dance floor 28 is occupied with tables; for example, during lunch. In that case, order-taking post 20 would concentrate more on food orders, particularly at the beginning of the lunch period.

The dotted line 102 along the telephone counter 78 represents an optional transparent partition, for example, a glass window, which encloses most of the bar area 16 except for the stairs 82 and 84. Enclosing the bar area 16 serves two purposes. It permits the more efficient use of a smoke exhaust system 85 (shown in dotted outline) mounted in the ceiling over the bar, where the cigarett and cigar smoke is most concentrated. It also lowers the noise transmitted from the bar to the rest of the restaurant. In that case, a microphone 87 hanging from the ceiling by suitable means (not shown) may be used to pick up background noise and feed it at controlled audio levels into the electronic audio amplifier system feeding the loud speakers throughout the restaurant. The audio amplifier system is preferably located at the order-taking post 20. An advantage of that feature is to make the restaurant sound more busy during lull hours.

The loudspeakers are mounted beneath the tables and contain their own volume controls so that the music and noise level may be kept low to permit converation and normal voice levels. The loudspeakers are described in greater detail in connection with FIG. 5.

In between dining hours, when the cocktail lounge and the bar may be busy, it is desirable to block the empty dining area from view. That is accomplished by a variably translucent partition 104 vertically mounted along the outer edge of the portion of the banquette 42 adjacent the cocktail lounge 18 and reaching a height above eye level. The variably-translucent partitions 104 are also useful to block inside areas from outside viewing, for example, through the window 94 in the dining area 12. The variably-translucent partitions 104 are described in greater detail in connection with FIG. 8.

ORDER-TAKING SYSTEM (FIGS. 1, 2–4)

Figure 2A:
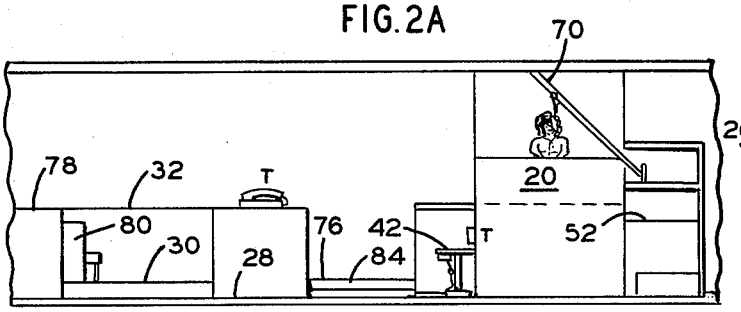
FIG. 2A is a front elevational view, taken along the lines 2A—2A of FIG. 1, of the order-taking post, a view of the kitchen through the kitchen door together with the music bar-bandstand showing the different levels (but excluding the tables around the dance floor).
Figure 2B:
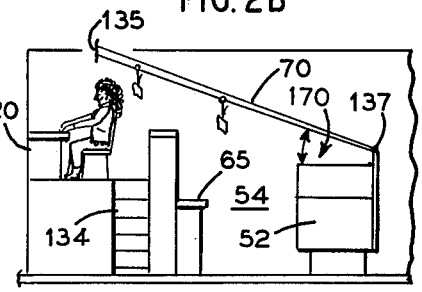
FIG. 2B is a side elevational view, taken along the lines 2B—2B of FIG. 1, of the order-taking post and showing a wire order conveyor carrying orders to the cooking area of the kitchen.
Figure 3:
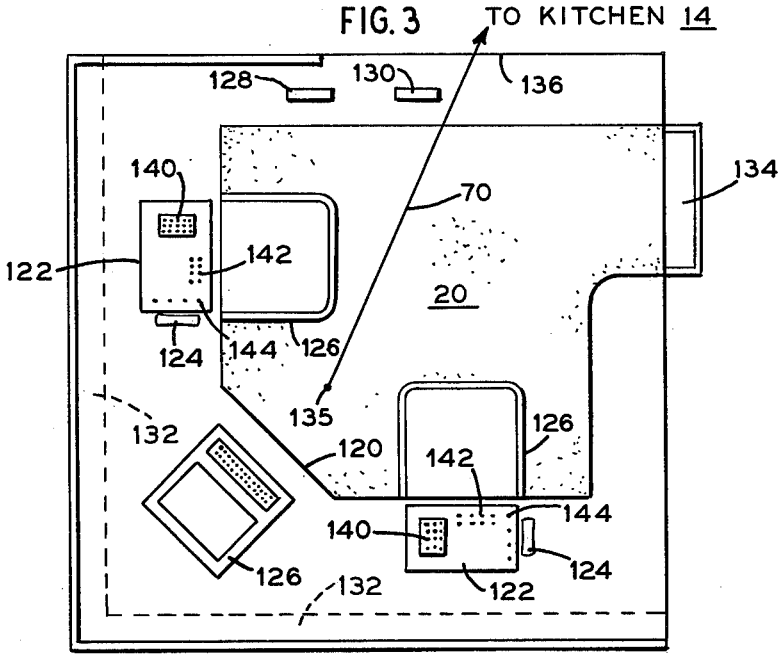
FIG. 3 is a detailed plan view of the order-taking post.
Figure 4A:
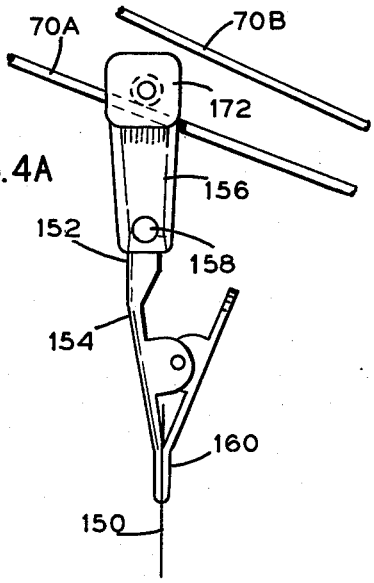
FIG. 4A is a front elevational view of a slide clip traversing the lower wire of the order conveyor showing a portion of an order card between the jaws of the slide clip.

The heart of the dining system invention of FIG. 1, the order-taking system, is shown in greater detail in FIGS. 2–4, with the same elements bearing the same reference numbers.

The hub of the order-taking system is the order-taking post 20 (FIG. 3). It generally comprises desk counter 120, telephone switchboards 122 together with associated telephones 124, a printing calculator 126, bar order slot 128, check slot 130, pigeonhole structure 132 and ladder 134. Connected from the roof by a suitable bracket 135 is the order conveyor 70, which traverses the order-taking post 20 and, via opening 136, enters the kitchen 14 and is connected to a bracket 137 at the cooking area 54 (FIGS. 1 and 2A-2B).

Order conveyor 70 is for food check orders. Bar check orders are inserted into bar order slot 128 and pass via a slide (not shown) to the service bar adjacent the order-taking post 20 (FIG. 1).

Telephone switchboards 122 (FIG. 3) each has a Touch-Tone button panel 140, incoming-line button switches 142 and control button switches 144. Control button switches 144 permit holding calls without disconnecting, handling several calls at once, and transferring calls to another phone or to an outside line. Talking and listening "hands free" may be provided with a speakerphone. A headset may be used in place of the telephone 124.

As orders are made out, duplicate copies are stored in the pigeonhole structure 132. When a check is requested, the separate amounts for drinks, entrees, desserts, etc., are totalled on the printing calculator 126. The addition tab is then stapled to the check which is dropped in the check slot 130 and passed via a slide (now shown) to the cashier position 65 (FIG. 1). The cashier then double-checks the total and gives the final check to a passing waiter or waitress for delivery to the table requesting the check.

Orders for drinks, food, etc., are taken by order-taking persons seated in chairs 126, which are on rollers and swivel in order to provide maximum mobility. A third chair 126 may be provided for the manager or assistant manager to survey and supervise the entire restaurant.

Each check is a suitable form printed on say a five inch by eight inch card having a thickness and stiffness similar to a file card. When the order is recorded on the order card, for example, order card 150 in FIG. 4A–4B, the card is positioned between the slidingly-gripping jaws of a slide clip 152. The slide clip 152 is then positioned between the wires 70A and 70B of the order conveyor 70, and riding on the lower wire 70A slides down into the kitchen 14 to the cooking area 54 (FIGS. 1, 2A–2B and 4A).

More particularly, slide clip 152 comprises an alligator clip 154 connected to a Teflon slide 156 via the nut-bolt connection 158. Alligator clip 154 is a standard alligator clip but with its teeth substantially flattened by inserting a steel sheet between its jaws 160 and then pressing the jaws with the sheet together in a vise. The purpose of substantially flattening the teeth is to permit the order card 150 to be pulled from between the jaws of the clip 154 by kitchen personnel without having to physically separate the jaws 160.

Slide 156 is a traverse slide normally used for supporting curtains. In the embodiment first reduced to practice and preferred, it is a traverse slide manufactured by Kirsch Co. of Sturgis, Mich., 49091, and marketed under style number 3909-B.

Wire 70A–70B in the preferred embodiment is armored polythermaleze antenna wire 14AWG Heavy with a diameter of one-sixteenth inch. In the preferred embodiment, the length of the order conveyor 70 is 174 inches with the starting position 54 inches higher than the terminal position so that the angle 170 with the horizontal is about 18 degrees (FIG. 2B). With that angle, the slide clips 152 with engaged order cards 150 slide down the order conveyor 70 at a moderate speed and with sufficient stability so that they do not fall off. The traversing speed is a function of the pull of gravity, and air and wire-slide resistance. If the angle 170 is too large, the slide clips 152 travel too fast and are unstable. If the angle 170 is too small, the slide clips 152 will not slide or will get stuck. Experiments have indicated a preferred range of angle 170 from 15° to 65°. Other angles may be workable depending on the parameters of the slide, friction and wire size, weight of the order card, etc.

Figure 4B:
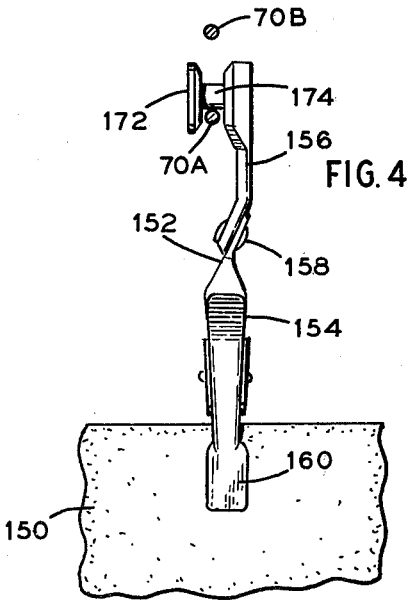
FIG. 4B is a side elevational view of the slide clip.

At the top of order conveyor 70, the wires 70A–70B are separated a distance greater than the height of the slide member 172 to permit the slide member 172 to be inserted between the wires 70A–70B and then positioned on wire 70A. Slide member 172 is connected to the main body of the slide 152 by the post 174 (FIG. 4B). The length of the post 174 is about one and one-half times the diameter of the wire 70A–70B. That spacing permits the slide clip 152 to move freely down the wire 70A.

At the lower end of the order conveyor 70, the wires 70A and 70B converge together at the mounting bracket 137 (FIG. 2B). In the preferred embodiment the inside spacing at the upper end is 1 inch and the inside spacing at the lower end is one-eight inch. Since the diameter of the post 174 of the slide clip 152 is three-sixteenth inch, the upper edge of the post 174 begins to engage the lower edge of wire 70B when the spacing between wires 70A–70B converge to about three-sixteenth inch. But the momentum of the combined slide clip 152 with engaged order card 150 is such that the post 174 tends to slightly separate the wires 70A–70B so that the result is to gradually decelerate the slide clip 152 and card 150. Thus, they come to a gradual halt, increasing stability while preventing them from bouncing off the wire 70A; especially because the slide member 172 is then bridging both wires 70A–70B so that any rebound or shock does not dislodge the slide clip 152 from the order conveyor 70.

In the preferred embodiment of the invention, the order-taking post is positioned adjacent both the kitchen area and the bar area, as shown in FIG. 1. Alternatively, the order-taking post can be positioned adjacent either the kitchen area or the bar area; for example, as shown in dotted outline as the order-taking post 100 in FIG. 1. Since order-taking post 100 is positioned adjacent the bar area, it is most convenient to pass drink order checks directly to the bar area. Any food orders would have to be sent to the kitchen 14 by some mechanical conveyor means; for example, pneumatic tube. The same would be the case for an order-taking post positioned adjacent only the kitchen. In that case the drink orders would be conveyed mechanically to the bar area; for example, by pneumatic tube. In some installations, it may even be necessary or desirable to physically communicate between the order-taking post and both the kitchen and bar area over a distance, say by pneumatic tubes.

The important principle is that there be physical communication between the order-taking post and the kitchen and bar areas so that the order checks can be transported to their desired destination. But what is essential is that the order-taking post be in visual communication with people in the cocktail lounge or dining area whose orders are being taken via the telephone communication system.

TABLE TELEPHONE AND AUDIO SYSTEM (FIG. 5)

A typical table for two, table 44A, is shown in FIGS. 5 and 6B. Phone T is positioned on the dining surface of the table 44A. It is preferably of the Trimline type in order to conserve space on the table surface.

Mounted beneath the table top, on its underside surface, is speaker cabinet 200. Mounted within speaker cabinet 200 is a substantially horizontal speaker (not shown) with its speaker cone directed downwardly. A speaker volume control 202 is mounted along one side of speaker cabinet 200. Knob 204 adjusts the volume of the audio signal from the speaker.

Speaker cabinet 200 serves as a junction box for telephone cable 206 and the combined telephone audio cable 208, attached to the supporting post 212 of table 44A. Combined cable 208 is connected to the central telephone and audio system via plug 210. Plug 210 comprises the male plug 210A and the mating female plug 210B positioned near the table pedestal 214. Included in combined cable 208 is a pair of wires used to signal any cutting of the telephone cable 206, discussed in greater detail in connection with FIG. 7. Plug 210B is connected to a flat multi-conductor cable 216.

In the embodiment of the system first reduced to practice, speaker cabinet 200 with speaker is of the surface mounted automotive type with a dual cone, eight ohm, three watt magnetic speaker, marketed by Radio Shack, A Tandy Corporation Company of Forth Worth, Tex. 76107, Cat. No. 12–1844. The volume control 202 is an eight ohm L-Pad for controlling any eight ohm speaker volume three watts continuous-ten watts peak. The specific volume control is from Radio Shack, Cat. No. 40–980.

DETACHABLE CARPET PANELS (FIGS. 5-6)

Table 44A rests on the floor separated by carpeting 220. Carpeting 220 comprises a plurality of rectangular carpet panels 222A, 222B, etc., (FIG. 6A) arranged in an abutting rectangular pattern and attached to the concrete floor by Velcro-type connecting strips. These connecting strips consist of two parts, one being a non-woven material such as felt and the other part being a flexible material provided with a plurality of small hook-like loops of a stiff resilient plastic material, such as nylon, projecting from the face of the material. When the two sections are pressed together, the hooks lock with the fibers of the felt, holding the two parts together. The parts can be separated by peeling one away from the other. The connection and separation may be repeated innumerable times. In a related (but patentably distinguishable) convertible floor system, rectangular carpet panels are detachably connected to Velcro-type felt strips mounted in grooves in a wooden floor in order to quickly convert a fully carpeted area into a dance floor; see U.S. Pat. No. 3,817,015 issued June 18, 1974 for a Convertible Floor System.

In the present system, a carpet panel 222 (FIG. 6A) comprises a tufted carpet section 224 with a rubber underlay 226. A recess 228 along the bottom of the outer edge of each carpet panel 222 is formed by removing a rectangular strip of rubber underlay having a width slightly larger than the width of the Velcro-type felt strip 230. Felt strip 230 is adhered to the underside of the carpet section 224 within the recess 228.

Cemented in a rectangular grid pattern 240 (FIG. 6B) to the concrete floor 242 are the matching loop strips 244. Each carpet panel 222 has a recess 228 along its outer edge on each of its four sides beneath its carpet section 224. Felt strips 230 thus surround the outer edges of each carpet panel 222 below its carpet section 224. Each carpet panel 222 may thus be connected to the concrete floor 242 by connecting the felt strips 230 to the matching loop strips 244 so that each carpet panel 222 abuts an adjacent carpet panel (except for the edges of the carpet).

The depth of the rubber underlay 226 is chosen to substantially equal the depth of the connected Velcro-type strips so that there is no bulge or depression at the abutting edges of the carpet panels 222.

The rectangular grid pattern of loop strips 244 is dimensioned so that each table 44A overlays abutting carpet panel edges. This permits the flat cable 216 to pass between the concrete floor 242 and the carpet panel 222 and exit between connecting Velcro-type strips beneath the table 44A as shown in FIGS. 5 and 6A. Thus a table 44A can be moved a limited amount and its cable 216 associated with its telephone number can be moved a corresponding amount so as to exit beneath the table 44A in its new position. The Velcro-type strips are temporarily separated to permit the movement of the flat cable 216.

This feature of the system also permits the ready replacement of carpet panels 222 which are worn, damaged or soiled, or to change the decorating theme.

VARIABLY-TRANSLUCENT PARTITIONS (FIGS. 1, 8)

In the dining system 10 of FIG. 1, variably-translucent partitions 104 separate the dining area 12 from the cocktail lounge 18 and from external viewing through the windows 94. Partition 104A is mounted on the top of the back portion of banquette 42 and extends at least to a height above eye level. Partitions 104B correspond in area to the windows 94.

The partitions 104 are made of transparent acrylic plastic sheets of the Lucite or Plexiglas type. They are colorless and crystal clear with a high coefficient of light transmission and little absorption of the light passing through. They function to pipe light introduced at their edges. The light leaves the panel at frosted or roughened surfaces. Their use as partitions is not new; see U.S. Pat. No. 2,609,436 issued Sept. 2, 1952 for Partition. Also see U.S. Pat. No. 2,634,530 issued Apr. 14, 1953 for an Edge Lighted Display, which discloses the edgelighted folded acrylic plastic sheet principle, shown in FIG. 8, which provides for uniform illumination of relatively large areas.

Partition 104 comprises a folded sheet 250 of acrylic plastic formed by bending along a median line over a straight edge while the material is in a softened condition due to heat previously applied at the fold 252. When folded the sheets are then in the form of two substantially flat superposed panels 254 and 256 joined at the fold 252. Before folding, one or both of the interior surfaces 258 and 260 is slightly roughened by sandblasting, engraving or embossing, for bleeding light.

An elongated incandescent light source 262 is mounted in base 264 A slot 266 in base 264 is adapted to receive the free ends of the panels 254 and 256, clamped by set screw 257 in close spaced parallel relation to the light source 262 so that light rays will be conducted away from the light source 262 through the panels 254 and 256. Variable voltage source 270 supplies the voltage for the light source 262. The variable voltage source 270 is preferably located at the order-taking post 20 (FIG. 1) so that the amount of light transmitted through the panels 254 and 256 can be controlled from that remote position.

By proper choice of the amount of roughening of the internal surfaces 258 and 260, the color, kind and power of the incandescent light source 262 and the amount of voltage supplied to it from the variable voltage source 270, the amount of light bled from the roughened surface can be controlled. That permits varying the visual translucency of the partition 204 from substantially transparent to substantially opaque. Moreover, the roughening can be in an artistic pattern, or visual artistic materials may be supported on the surface of or between the panels 254 and 256.

PHONE PROTECTOR SYSTEM (FIGS. 5, 7)

There is a significant risk that a patron may want to remove one of the phones T; for example, as a souvenir. In order to forestall that, a phone protector system is provided as shown in FIG. 7. An extra pair of wires 280 (FIG. 7A) is included in the phone cable 206 (FIG. 5). Comprising wires 280A and 280B, they are connected together within the phone T. Each of the pairs 280 fed to a plurality of phones T is connected in series relation with a relay 282. The series circuit includes the voltage source V and the operative coil of the relay 282 so that normally the relay 282 is in a closed position. Voltage source V also feeds the indicator 284 via a pair of normally open relay contacts.

If the telephone cable 206 is cut in an attempt to remove the phone T (FIG. 5), then relay 282 will open and indicator 284 be operated. Indicator 284 is preferably a signal light positioned at the order-taking post. A buzzer may be connected in parallel with it to give an audio indication at the same time. The order-taking person will then be alerted to scan the tables to see any suspicious activity or whether a telephone has already been removed.

The phone protector circuit of FIG. 7A does not indicate which phone cable 206 has been cut. If that is desired, then a plurality of individual series circuits can be provided as in FIG. 7B, one for each telephone T'. Corresponding parts are designated with the same reference character but with a prime designation added. A board containing an array of indicators 284', preferably located at the order-taking post 20, will then permit the identification of the severed phone cable 206.

What is claimed is:

1. A dining system comprising:

(a) a dining area having a plurality of separate dining surfaces;

(b) a kitchen area for preparing food ordered by people at dining surfaces in said dining area;

(c) a bar area for preparing drinks ordered by people at dining surfaces in said dining area;

(d) an order-taking post physically separate from but in physical communication with both said kitchen area and said bar area and in two way visual communication with people at dining surfaces in said dining area;

(e) a telephone communication system for taking oral orders from people at dining surfaces in said dining area comprising (1) a plurality of telephones each positioned within reach of a person at one of said dining surfaces in said dining area, and (2) a telephone at said order-taking post;

(f) whereby a person at said order-taking post can both see and communicate by telephone with a person at a dining surface, who can see the order-taking person, to initiate and physically record an order for physical transmission to the kitchen area; and (g) conveyor means positioned between said order-taking post and said kitchen area for conveying recorded orders from said order-taking post to said kitchen area.

2. The dining system of claim 1 wherein said order-taking post is positioned abutting both the kitchen area and the bar area.

3. The dining system of claim 1 wherein the floor of the order-taking post is a first predetermined distance above the floor of the dining area to facilitate visual communication between the order-taking post and the dining area.

4. The dining system of claim 1 further comprising:

(a) plurality of Velcro-type connecting strips each with its nonconnecting side attached in a rectangular grid pattern to the floor of said dining area; and (b) a plurality of rectangular carpet panels, each carpet panel sized so that its edges overlie a portion of a connecting strip and abut an adjacent carpet panel, (c) each carpet panel having (1) a recess along and beneath its outer edges and (2) a mating Velcro-type connecting strip with its non-connecting side attached to the underside of the carpet panel within its recess. (3) said recess having a depth substantially equal to the thickness of the connected mating Velcro-type connected strips so that there is no substantial bulge or depression at the abutting edges of said carpet panels.

5. The dining system of claim 1 further comprising a variably controllable translucent partition adjacent said dining area.

6. The dining system of claim 5 wherein said variably-translucent partition comprises an edge-lighted light-transmitting panel with a roughened surface.

7. A dining system comprising:

(a) a dining area having a plurality of separate dining surfaces;

(b) a kitchen area for preparing food ordered by people at dining surfaces in said dining area;

(c) a bar area for preparing drinks ordered by people at dining surfaces in said dining area;

(d) an order-taking post physically separate from but in physical communication with both said kitchen area and said bar area and in visual communication with people at dining surfaces in said dining area; and (e) a telephone communication system for taking oral orders from people at dining surfaces in said dining area comprising (1) a plurality of telephones each positioned within reach of people at one of said dining surfaces in said dining area, and (2) a telephone at said order-taking post;

(f) whereby a person at said order-taking post can both see and communicate by telephone with a person at a dining surface to take and physically record an order for physical transmission to the kitchen area or the bar area; and (g) wherein the floor of the order-taking post is a first predetermined distance above the floor of the dining area to facilitate visual communication between the order-taking post and the dining area; and (h) wherein the floor of the bar area is a second predetermined distance above the floor of the dining area; and (i) further including at least one telephone at said bar area positioned so that a person in the bar area can see and talk by telephone with a person in the dining area.

8. The dining system of claim 7 wherein the first predetermined distance is greater than the second predetermined distance so that a person in the order-taking post can see over people in the bar area.

9. A dining system comprising:

(a) a dining area having a plurality of separate dining surfaces;

(b) a kitchen area for preparing food ordered by people at dining surfaces in said dining area;

(c) a bar area for preparing drinks ordered by people at dining surfaces in said dining area;

(d) an order-taking post physically separate from but in physical communication with both said kitchen area and said bar area and in visual communication with people at dining surfaces in said dining area; and (e) a telephone communication system for taking oral orders from people at dining surfaces in said dining area comprising (1) a plurality of telephones each positioned within reach of people at one of said dining surfaces in said dining area, and (2) a telephone at said order-taking post;

(f) whereby a person at said order-taking post can both see and communicate by telephone with a person at a dining surface to take and physically record an order for physical transmission to the kitchen area or the bar area; and (g) an order conveyor means positioned between the order-taking post and the bar area.

10. A dining system comprising:

(a) a dining area having a plurality of separate dining surfaces;

(b) a kitchen area for preparing food ordered by people at dining surfaces in said dining area;

(c) a bar area for preparing drinks ordered by people at dining surfaces in said dining area;

(d) an order-taking post physically separate from but in physical communication with both said kitchen area and said bar area and in visual communication with people at dining surfaces in said dining area; and (e) a telephone communication system for taking oral orders from people at dining surfaces in said dining area comprising (1) a plurality of telephones each positioned within reach of people at one of said dining surfaces in said dining area, and (2) a telephone at said order-taking post;

(f) whereby a person at said order-taking post can both see and communicate by telephone with a person at a dining surface to take and physically record an order for physical transmission to the kitchen area or the bar area; and (g) an elongated bar counter in the bar area to facilitate service to patrons in the bar area; and (h) a transparent partition parallel to said bar counter and substantially enclosing the bar area and separating the bar area from the adjacent area.

11. The dining system of claim 10 further comprising a smoke exhaust system mounted over the bar area for exhausting tobacco smoke.

12. A dining system comprising:

(a) a dining area having a plurality of separate dining surfaces;

(b) a kitchen area for preparing food ordered by people at dining surfaces in said dining area;

(c) a bar area for preparing drinks ordered by people at dining surfaces in said dining area;

(d) an order-taking post physically separate from but in physical communication with both said kitchen area and said bar area and in visual communication with people at dining surfaces in said dining area; and (e) a telephone communication system for taking oral orders from people at dining surfaces in said dining area comprising (1) a plurality of telephones each positioned within reach of people at one of said dining surfaces in said dining area, and (2) a telephone at said order-taking post;

(f) whereby a person at said order-taking post can both see and communicate by telephone with a person at a dining surface to take and physically record an order for physical transmission to the kitchen area or the bar area; and (g) wherein some of the dining surfaces in said dining area are tables; and (h) an electronic music source including an audio amplifier;

(i) a loud speaker mounted on the underside of each table;

(j) electrical music conductors for feeding music from the electronic music source to said loud speakers; and (k) a volume control at each of said tables to control the volume of the music emanating from its associated loud speaker.

13. The dining system of claim 12 wherein control of said electronic music source is located at said order-taking post.

14. The dining system of claim 12 further comprising:

(a) a transparent partition substantially enclosing the bar area; and (b) a microphone means mounted within said enclosed bar area for sensing background noise and feeding the sensed noise to the audio amplifier of said electronic music source at a controlled audio level.

15. A dining system comprising:

(a) a dining area having a plurality of separate dining surfaces;

(b) a kitchen area for preparing food ordered by people at dining surfaces in said dining area;

(c) a bar area for preparing drinks ordered by people at dining surfaces in said dining area;

(d) an order-taking post physically separate from but in physical communication with both said kitchen area and said bar area and in visual communication with people at dining surfaces in said dining area; and (e) a telephone communication system for taking oral orders from people at dining surfaces in said dining area comprising (1) a plurality of telephones each positioned within reach of people at one of said dining surfaces in said dining area, and (2) a telephone at said order-taking post;

(f) whereby a person at said order-taking post can both see and communicate by telephone with a person at a dining surface to take and physically record an order for physical transmission to the kitchen area or the bar area; and (g) a plurality of Velcro-type connecting strips each with its nonconnecting side attached in a rectangular grid pattern to the floor of said dining area; and (h) a plurality of rectangular carpet panels, each carpet panel sized so that its edges overlie a portion of a connecting strip and abut an adjacent carpet panel, (i) each carpet panel having (1) a recess along and beneath its outer edges and (2) a mating Velcro-type connecting strip with its non-connecting side attached to the underside of the carpet panel within its recess, (3) said recess having a depth substantially equal to the thickness of the connected mating Velcro-type connected strips so that there is no substantial bulge or depression at the abutting edges of said carpet panels; and (j) electrical conductors; and (k) wherein the electrical conductors pass beneath the carpet panels and exit between two abutting edges.

16. The dining system of claim 15 wherein the electrical conductors comprise telephone conductors and music conductors and wherein both the telephone conductors and the music conductors pass beneath the carpet panels and exit between two abutting edges.

17. The dining system of claim 16 wherein some dining surfaces are movable tables and the dimensions of said rectangular grid pattern are such that the movable tables always overlie abutting edges of carpet panels so that electrical conductors can be moved to exit beneath a moved table by temporarily separating the mating connecting strips of the associated carpet panels.

18. A dining system comprising:

(a) a dining area having a plurality of separate dining surfaces;

(b) a kitchen area for preparing food ordered by people at dining surfaces in said dining area;

(c) a bar area for preparing drinks ordered by people at dining surfaces in said dining area;

(d) an order-taking post physically separate from but in physical communication with both said kitchen area and said bar area and in visual communication with people at dining surfaces in said dining area; and (e) a telephone communication system for taking oral orders from people at dining surfaces in said dining area comprising (1) a plurality of telephones each positioned within reach of people at one of said dining surfaces in said dining area, and (2) a telephone at said order-taking post;

(f) whereby a person at said order-taking post can both see and communicate by telephone with a person at a dining surface to take and physically record an order for physical transmission to the kitchen area or the bar area; and (g) wherein some of said dining surfaces are tables with telephones positioned on the tables and said telephone communication system includes a telephone cable connected to each telephone on a table, said dining system further comprising a telephone protection system comprising:

(1) a pair of wires in each of said telephone cables;

(2) signal coupling means within each telephone coupling each wire of said pair together;

(3) a signal source;

(4) circuit connecting means for connecting all of said coupled pairs in a series circuit with said signal source; and (5) circuit interruption indicating means connected in said circuit for giving an indication when said circuit is broken.

19. The dining system of claim 18 wherein said circuit interruption indicating means is located at said order-taking post.

20. A dining system comprising:

(a) a dining area having a plurality of separate dining surfaces;

(b) a kitchen area for preparing food ordered by people at dining surfaces in said dining area;

(c) a bar area for preparing drinks ordered by people at dining surfaces in said dining area;

(d) an order-taking post physically separate from but in physical communication with both said kitchen area and said bar area and in visual communication with people at dining surfaces in said dining area; and (e) a telephone communication system for taking oral orders from people at dining surfaces in said dining area comprising (1) a plurality of telephones each positioned within reach of people at one of said dining surfaces in said dining area, and (2) a telephone at said order-taking post;

(f) whereby a person at said order-taking post can both see and communicate by telephone with a person at a dining surface to take and physically record an order for physical transmission to the kitchen area or the bar area; and (g) wherein some of said dining surfaces are tables with telephones positioned on the tables and said telephone communication system includes a telephone cable connected to each telephone on a table, said dining system further comprising a telephone protection system comprising:

(1) a pair of wires in each of said telephone cables;

(2) signal coupling means within each telephone coupling each wire of said pair together; and (3) a plurality of circuit interruption indicating means each connected in circuit with one pair of wires in a telephone cable for giving an indication when said circuit is broken.

21. The dining system of claim 20 wherein said plurality of circuit interruption indicating means is located at said order-taking post.

22. A dining system comprising:

(a) a dining area having a plurality of separate dining surfaces;

(b) a kitchen area for preparing food ordered by people at dining surfaces in said dining area;

(c) a bar area for preparing drinks ordered by people at dining surfaces in said dining area;

(d) an order-taking post physically separate from but in physical communication with both said kitchen area and said bar area and in visual communication with people at dining surfaces in said dining area; and (e) a telephone communication system for taking oral orders from people at dining surfaces in said dining area comprising (1) a plurality of telephones each positioned within reach of people at one of said dining surfaces in said dining area, and (2) a telephone at said order-taking post;

(f) whereby a person at said order-taking post can both see and communicate by telephone with a person at a dining surface to take and physically record an order for physical transmission to the kitchen area or the bar area; and (g) a dance floor area positioned adjacent to said bar area and lower than the floor of the bar area; and (h) a bandstand positioned in and extending from the bar area into said dance floor area.

23. The dining system of claim 22 further comprising a counter around a portion of said bandstand in said bar area.

24. The dining system of claim 23 wherein the floor of said bandstand is at the same level as the floor of said bar area.

25. A dining system comprising:

(a) a dining area having a plurality of separate dining surfaces;

(b) a kitchen area for preparing food ordered by people at dining surfaces in said dining area;

(c) a bar area for preparing drinks ordered by people at dining surfaces in said dining area;

(d) an order-taking post physically separate from but in physical communication with both said kitchen area and said bar area and in visual communication with people at dining surfaces in said dining area; and (e) a telephone communication system for taking oral orders from people at dining surfaces in said dining area comprising (1) a plurality of telephones each positioned within reach of people at one of said dining surfaces in said dining area, and (2) a telephone at said order-taking post;

(f) whereby a person at said order-taking post can both see and communicate by telephone with a person at a dining surface to take and physically record an order for physical transmission to the kitchen area or the bar area; and (g) a variably controllable translucent partition adjacent said dining area;

(h) wherein said variably controllable translucent partition comprises an edge-lighted light-transmitting panel with a roughened surface; and (i) a voltage control means for controlling the amount of light transmitted through said light-transmitting panel, and thereby the amount of light transmitted from its roughened surface, for controlling the amount of translucency of said partition.

26. The dining system of claim 25 wherein said voltage control means is located at said order-taking post.

27. A dining system comprising:

(a) a dining area having a plurality of separate dining surfaces;

(b) a kitchen area for preparing food ordered by people at dining surfaces in said dining area;

(c) a bar area for preparing drinks ordered by people at dining surfaces in said dining area;

(d) an order-taking post physically separate from but in physical communication with both said kitchen area and said bar area and in visual communication with people at dining surfaces in said dining area; and (e) a telephone communication system for taking oral orders from people at dining surfaces in said dining area comprising (1) a plurality of telephones each positioned within reach of people at one of said dining surfaces in said dining area, and (2) a telephone at said order-taking post;

(f) whereby a person at said order-taking post can both see and communicate by telephone with a person at a dining surface to take and physically record an order for physical transmission to the kitchen area or the bar area; and (g) a variably controllable translucent partition adjacent said dining area; and (h) wherein said variably controllable translucent partition comprises:

(1) an edge-lighted light-transmitting panel having a surface roughened by an amount which has no substantial effect on its transparency;

(2) edge-lighting means positioned along the bottom edge of said light-transmitting panel; and (3) variable voltage means connected to said edge-lighting means for increasing the voltage and thereby increasing the light transmitted through said light-transmitting panel, (4) whereby increasing the transmitted light increases the light exiting from the roughened surface of said light-transmitting panel thereby varying the translucency of said panel from substantially transparent to substantially opaque.

28. A food or drink service system comprising:

(a) a table area having a plurality of separate tables;

(b) a preparation area for preparing food or drinks ordered by people at tables in said table area;

(c) an order-taking post physically separate from said preparation area and in visual communication with people at tables in said table area who are in visual communication with said order-taking post;

(d) a telephone communication system for taking oral orders from people at tables in said table area comprising (1) a plurality of telephones each positioned within reach of a person at one of said tables in said table area and (2) a telephone at said order-taking post:

(e) whereby a person at said order-taking post can both view and communicate by telephone with a person at a table, who can view the order-taking person, to initiate and physically record an order for transmission to the preparation area; and (f) means connected between said order-taking post and said preparation area for transmitting recorded orders from said order-taking post to said preparation area.

29. The system of claim 28 wherein said order-taking post is positioned adjacent the preparation area.

30. The system of claim 29 wherein the floor of the order-taking post is a predetermined distance above the floor of the table area to facilitate visual communication between the order-taking post and the table area.

31. The system of claim 28 wherein the floor of the order-taking post is a predetermined distance above the floor of the table area to facilitate visual communication between the order-taking post and the table area.

32. A food or drink service system comprising:

(a) a table area having a plurality of separate tables;

(b) a preparation area for preparing food or drinks;

(c) an order-taking post physically separate from said preparation area and in two way visual communication with tables in said table area; and (d) an electrical audio signal communication system for taking oral orders from people at tables in said table area comprising (1) a plurality of audio transmitter-receivers each positioned near a person at one of said tables in said table area and (2) an audio transmitterreceiver at said order-taking post;

(e) whereby a person at said order-taking post can both see and communicate by electrical audio signal transmission with a person at a table, who can see the order-taking person, to initiate and physically record an order for transmission to the preparation area.

33. The system of claim 32 wherein said order-taking post is positioned adjacent the preparation area.

34. The system of claim 33 wherein the floor of the order-taking post is a predetermined distance above the floor of the table area to facilitate visual communication between the order-taking post and the table area.

35. The system of claim 32 wherein the floor of the order-taking post is a predetermined distance above the floor of the table area to facilitate visual communication between the order-taking post and the table area.

* * * * *